US006834592B2

(12) United States Patent
Koger

(10) Patent No.: US 6,834,592 B2
(45) Date of Patent: Dec. 28, 2004

(54) MODULAR CONSTRUCTION SYSTEM FOR SHELLS

(75) Inventor: Gottfried Koger, Offenhausen (AT)

(73) Assignee: Armaturen-Gesellschaft m.b.H., Rustorf (AT)

( * ) Notice: Subject to any disclaimer, the term of this patent is extended or adjusted under 35 U.S.C. 154(b) by 0 days.

(21) Appl. No.: 10/245,343

(22) Filed: Sep. 18, 2002

(65) Prior Publication Data

US 2003/0051626 A1 Mar. 20, 2003

(30) Foreign Application Priority Data

Sep. 19, 2001 (AT) ..... A 1481/2001

(51) Int. Cl.[7] ..... F42B 10/00
(52) U.S. Cl. ..... 102/439; 102/473
(58) Field of Search ..... 102/473, 517, 102/518, 519, 439, 430, 501, 374, 513, 502

(56) References Cited

U.S. PATENT DOCUMENTS

| | | | | | |
|---|---|---|---|---|---|
| 465,230 | A | * | 12/1891 | Wilson, Jr. | 102/519 |
| 740,849 | A | * | 10/1903 | Groff | 102/519 |
| 875,023 | A | * | 12/1907 | Wheeler, Jr. et al. | 102/519 |
| 950,586 | A | * | 3/1910 | Wheeler, Jr. et al. | 102/519 |
| RE13,132 | E | * | 7/1910 | Gathmann | 102/519 |
| 1,149,602 | A | * | 8/1915 | Strange | 102/519 |
| 1,153,460 | A | * | 9/1915 | Strange | 102/519 |
| 1,312,762 | A | * | 8/1919 | Strang | 102/519 |
| 1,383,012 | A | * | 6/1921 | Rys | 102/519 |
| 2,197,841 | A | * | 4/1940 | Slaughter | 102/473 |
| 2,401,380 | A | * | 6/1946 | Teitscheid | 102/519 |
| 3,045,753 | A | * | 7/1962 | Goodwin | 166/55 |
| 3,911,824 | A | | 10/1975 | Barr et al. | |
| 4,038,923 | A | | 8/1977 | Cole et al. | |
| 4,353,302 | A | * | 10/1982 | Strandli et al. | 102/364 |
| 4,848,237 | A | * | 7/1989 | Zedrosser | 102/471 |
| 4,905,602 | A | * | 3/1990 | Buckland | 102/520 |
| 4,938,146 | A | | 7/1990 | Günther et al. | |
| 5,035,183 | A | * | 7/1991 | Luxton | 102/502 |
| 5,115,707 | A | * | 5/1992 | Kutzli | 86/20.1 |
| 5,333,551 | A | | 8/1994 | Heitmann et al. | |
| 5,353,710 | A | * | 10/1994 | Eches et al. | 102/443 |
| 5,505,137 | A | * | 4/1996 | Godefroy et al. | 102/529 |
| 5,649,638 | A | * | 7/1997 | Roy et al. | 220/4.26 |

FOREIGN PATENT DOCUMENTS

DE 4202780 A1 8/1993

OTHER PUBLICATIONS

Gerald Hendricks, Modular Weapons, Jan.–Feb. 1973; Ordance.*

* cited by examiner

*Primary Examiner*—Michael J. Carone
*Assistant Examiner*—Jordan Lofdahl
(74) *Attorney, Agent, or Firm*—Wenderoth, Lind & Ponack L.L.P.

(57) ABSTRACT

A modular construction system includes identical container-like shell bodies (1), fillings (2) matched to the respective application, and different shell heads (3, 3', 3") suitable for the respective application.

20 Claims, 5 Drawing Sheets

MODULAR CONSTRUCTION SYSTEM FOR SHELLS

BACKGROUND OF THE INVENTION

The invention relates to a modular construction system for shells (particularly, 40 mm shells) for different uses. In particular, the modular construction system has identical shell bodies and shell heads matched for respective application.

Such modular construction systems (specifically, of the 40 mm type) have a container defining the shell body or shell, which is filled according to the particular use, and is closed by a front shell head. The shell head thus provides a closing or lid function, while also providing an application-specific function. For example, in the case of explosive shells, the shell head bursts following percussion and releases the contents (marking dye, smoke, and so forth). In these instances, the shell head is fabricated from plastics and provided with pre-determined breakage points.

SUMMARY OF THE INVENTION

In order to now obtain economical fabrication and the same technical parameters in use, the object of the present invention is to provide a modular construction system for shells, in which the shell bodies are constructed as a container and the shell heads can be selected based on different fillings and from different shell tips matched to the fillings. In other words, each different type of shell head is appropriate for use with at least one of the different types of fillings, and an appropriate shell head is thus selected based on the type of filings. The shell heads form a closure of the shell body.

In such a modular construction system, all the shell bodies can now be produced using a single tool. Adaptations of the shell body can then possibly take place based on the intended use, for example, coloration or boring of a hole in the base of the shell body.

Based on the intended use, filling then takes place, and the purpose-specific shell head (i.e., the shell head appropriate for use with the selected fillings) is selected, with which the shell body is then closed. At least two such shell heads are provided, according to whether there is to be an explosive or non-explosive shell. Optionally, another two or three different shell heads are provided for non-explosive shells.

The unitary connection of the shell body and the shell tip selected can be constructed as a screw connection, bayonet connection, snap connection, or the like.

BRIEF DESCRIPTION OF THE DRAWINGS

The invention will now be described below with reference to the attached drawings, in which.

DETAILED DESCRIPTION OF THE INVENTION

Figure 1:
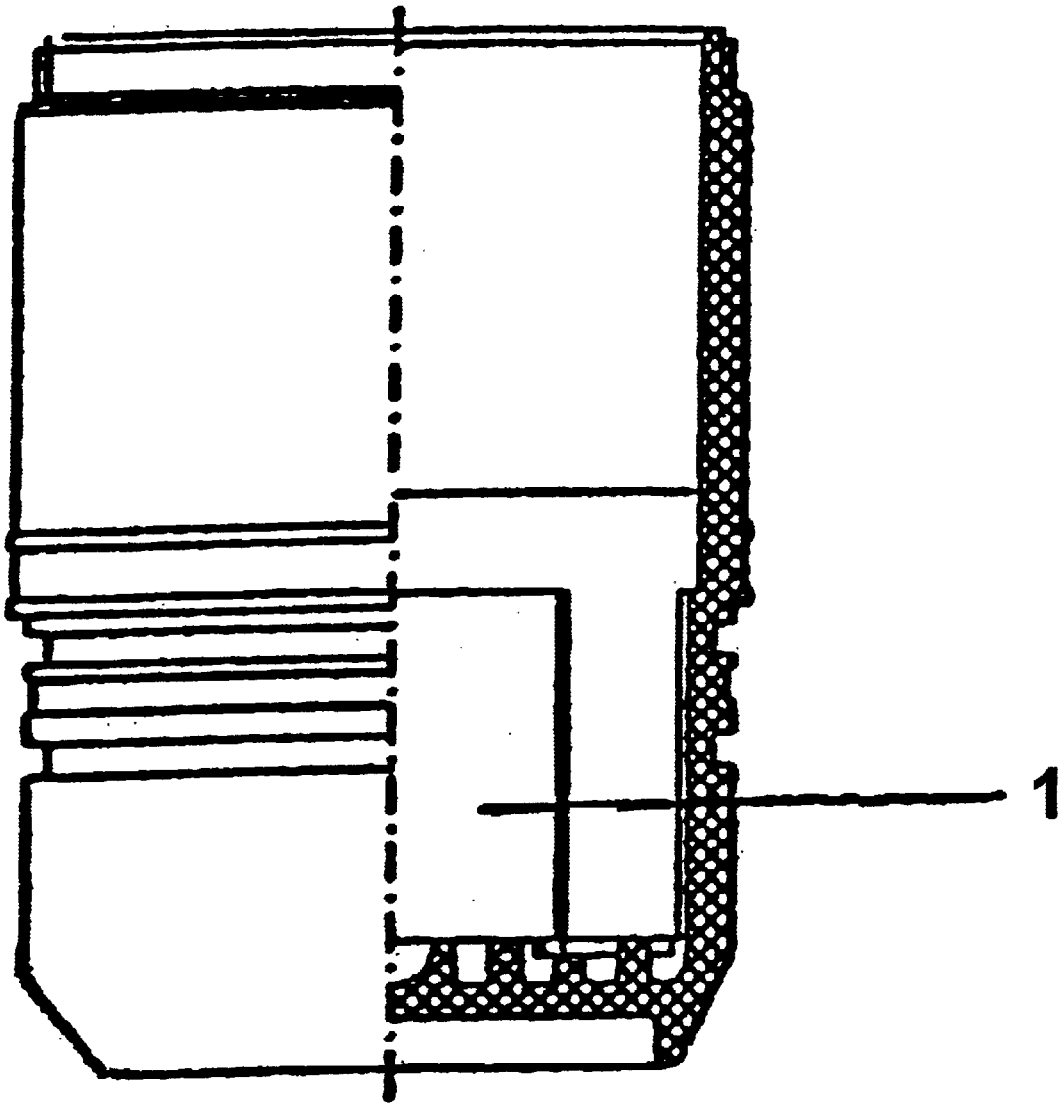
FIG. 1 is a partial sectional view of a shell body of the present invention.

The modular construction system includes identical shell bodies 1, such as that shown in FIG. 1. Each shell body is shaped as a cylindrical container for an application-specific filling 2. According to the type of shell to be constructed, the shell body 1 is closed by one of an application-specific selected shell head 3, 3', 3" (for example, screwed on, latched on, or glued on) as shown in FIGS. 2–4, respectively.

Figure 2:
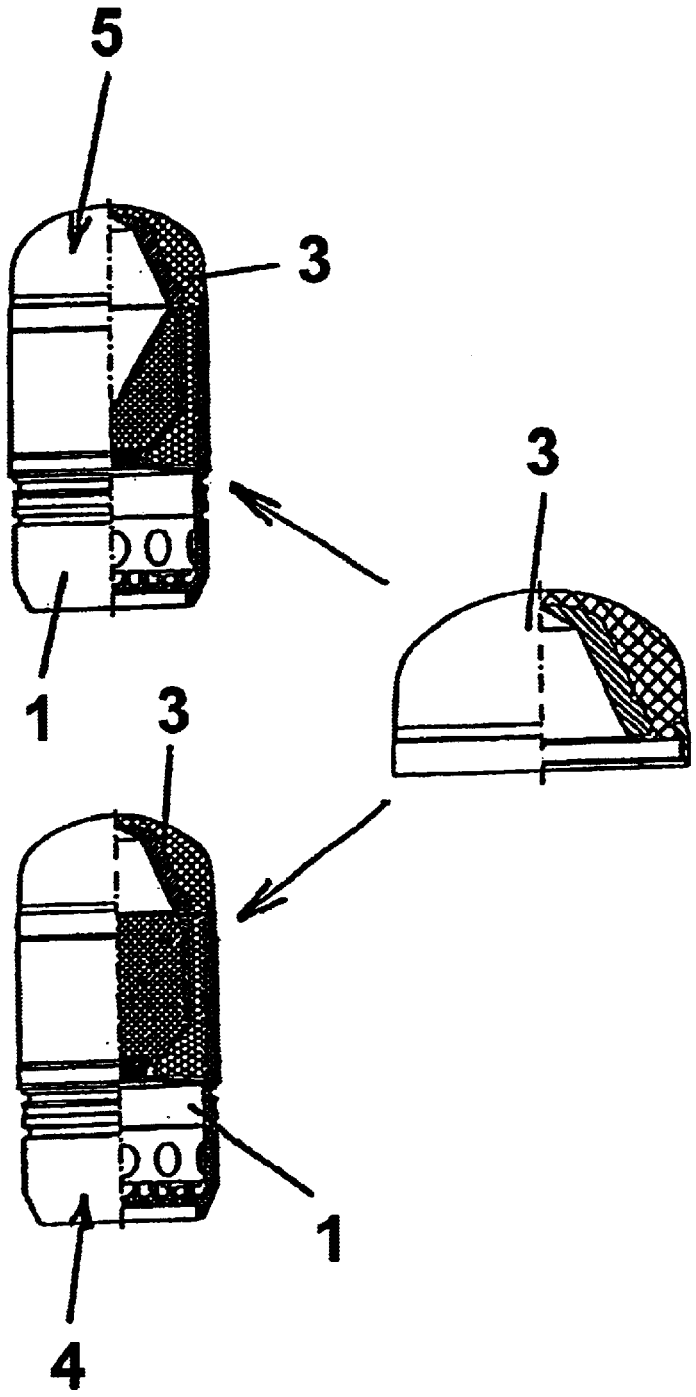
FIG. 2 is a partial sectional view of a first embodiment of a shell head for closing a shell body of the present invention.

For explosive shells, a fragmentation filling and explosive filling are used, and a shell tip 3 of metal or a thermoplastic material is placed, preferably with a rubber-type bearing, on the shell body 1 as shown in FIG. 2. Corresponding explosive shells 4, 5 are shown on the left-hand side of the drawing.

Figure 3:
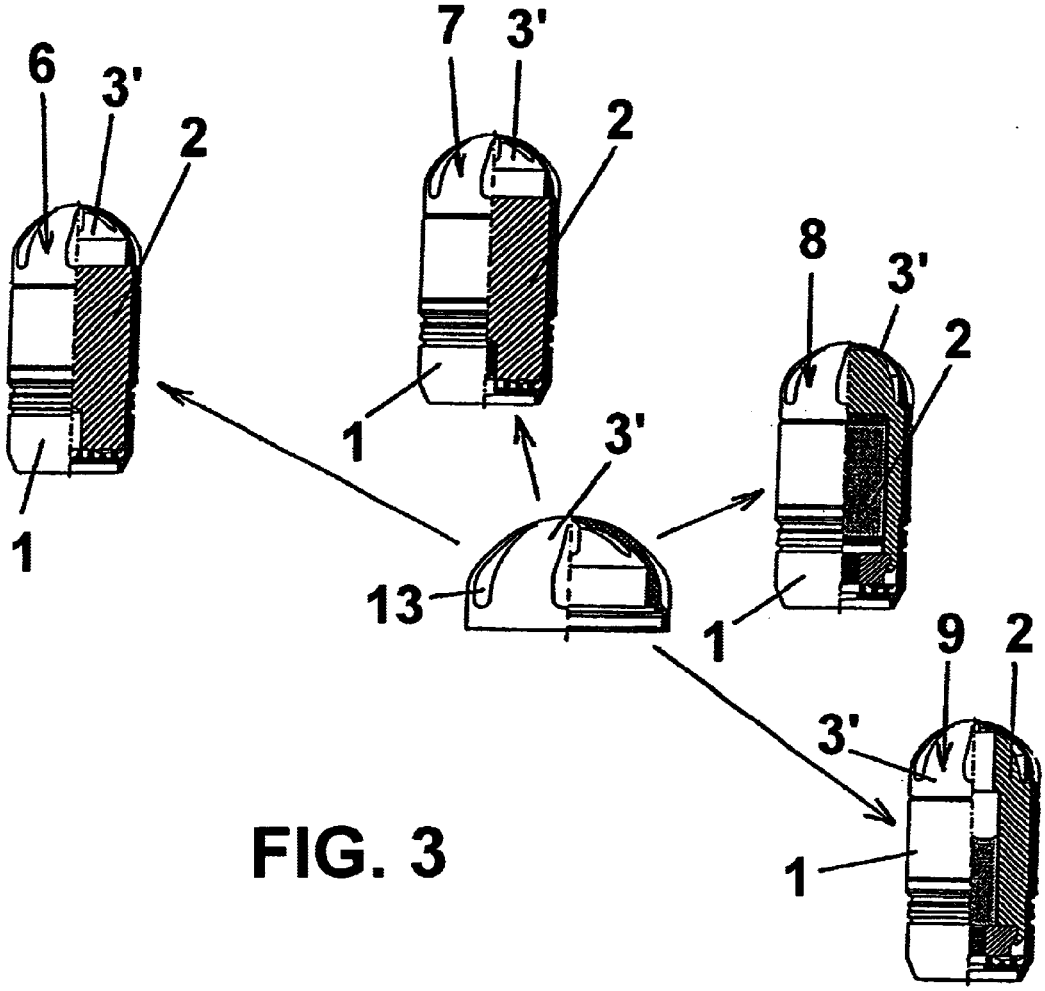
FIG. 3 is a partial sectional view of a second embodiment of a shell head for closing a shell body of the present invention.

FIG. 3 shows four non-explosive shells 6, 7, 8, and 9. These are composed of the shell body 1, the application-specific filling 2 (ballast, flare compound, tear gas, detonation charge, marking dye, marking dye with light trace, smoke compound), and shell head 3' formed of plastics material. The plastics shell head 3' has ray-shaped pre-determined breakage points 13.

Figure 4:
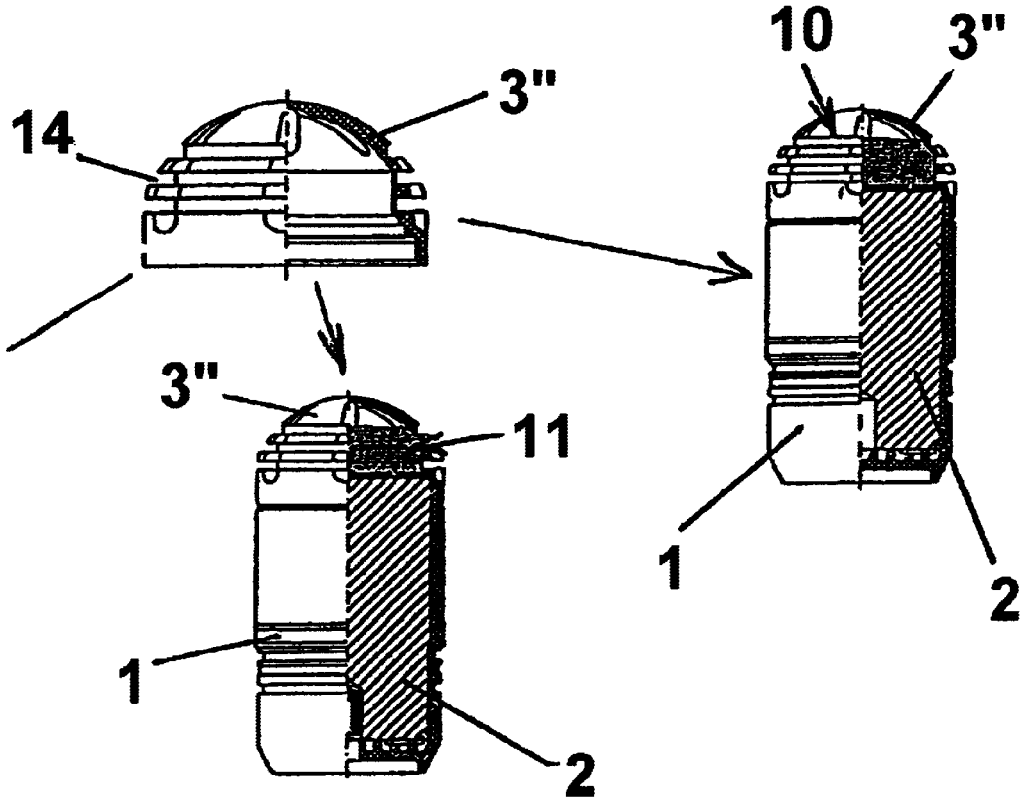
FIG. 4 is a partial sectional view of a third embodiment of a shell head for closing a shell body of the present invention, and FIG. 5 are views including a partial sectional view of a shell in FIG. 5A, a detail view of a first type of a head-to-body connection in FIG. 5B, and a sectional view of a second type of head-to-body connection in FIG. 5C.

FIG. 4 shows three non-explosive shells 10, 11 and 12. These shells include shell body 1, the desired filling 2 (ballast, flare compound, tear gas, detonation charge, marking dye marking dye with light trace, smoke compound), and shell head 3" formed of plastics material. The plastics shell head 3" has additional grooves around the periphery.

Figure 5C:
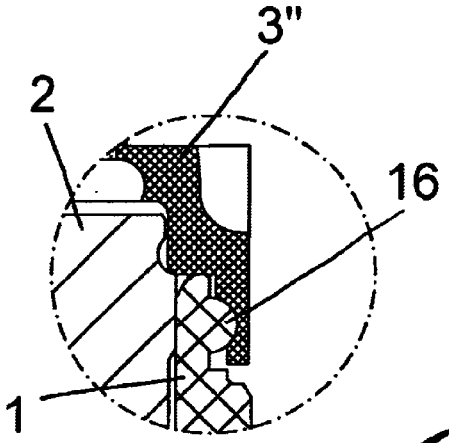
Figure 5B:
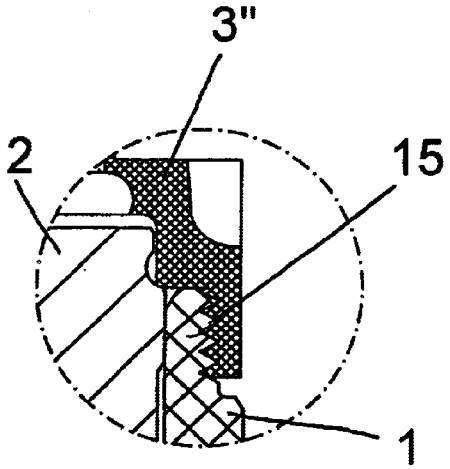
Figure 5A:
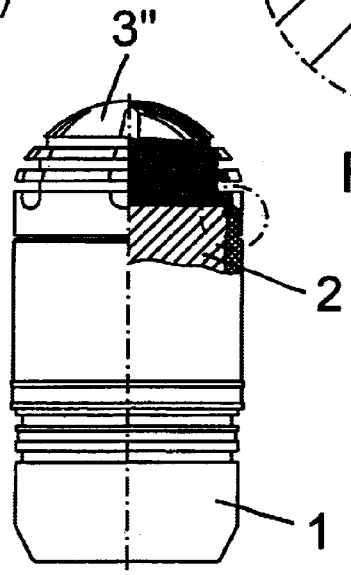

FIG. 5 illustrates various manners in which the shell head 3, 3' 3" can be connected to the shell body 1. In particular, FIG. 5B shows a thread 15 at the edge of shell body 1 onto which the shell head 3, 3', 3" is screwed. Alternatively, FIG. 5C shows an annular bead 16 at the edge of shell body 1 onto which the shell head 3, 3', 3" can be snapped. Although only head 3" is shown in FIG. 5, these connections are also applicable to shell heads 3, 3'.

What is claimed is:

1. A modular shell system including at least one explosive shell and at least one non-explosive shell, said modular shell system comprising:

a plurality of shell bodies of the same type, each of said shell bodies being formed as a container;

a plurality of fillings of different types, said different types including at least one explosive type and at least one non-explosive type, one of said fillings to be contained within each of said shell bodies; and a plurality of shell heads of different types, each of said plurality of different types of shell heads being appropriate for use with at least one of said plurality of different types of fillings, an appropriate one of said shell heads to be connected to each of said shell bodies based on said one of said fillings to be contained within said each of said shell bodies, whereby each of said fillings is enclosed by one of said shell bodies and said appropriate one of said shell heads to form said at least one explosive shell and said at least one non-explosive shell.

2. The modular shell system of claim 1, wherein each of said shell bodies and said appropriate one of said shell heads are connected to form a 40 mm shell.

3. The modular shell system of claim 1, wherein each of said shell bodies has a thread formed at an edge thereof, each of said shell heads being operable to be connected to one of said shell bodies by being screwed onto said thread of said one of said shell bodies.

4. The modular shell system of claim 3, wherein said plurality of shell heads of different types include at least one shell head having ray-shaped predetermined breakage points.

5. The modular shell system of claim 3, wherein said plurality of shell heads of different types include at least one shell head having a plurality of grooves formed around a periphery thereof.

6. The modular shell system of claim 1, wherein each of said shell bodies has an annular bead formed at an edge thereof, each of said shell heads being operable to be connected to one of said shell bodies by being snapped over said annular bead of said one of said shell bodies.

7. The modular shell system of claim 6, wherein said plurality of shell heads of different types include at least one shell head having ray-shaped predetermined breakage points.

8. The modular shell system of claim 6, wherein said plurality of shell heads of different types include at least one shell head having a plurality of grooves formed around a periphery thereof.

9. The modular shell system of claim 1, wherein said plurality of shell heads of different types include at least one shell head having ray-shaped predetermined breakage points.

10. The modular shell system of claim 9, wherein said plurality of shell heads of different types further include at least one shell head having a plurality of grooves formed around a periphery thereof.

11. The modular shell system of claim 1, wherein said plurality of shell heads of different types include at least one shell head having a plurality of grooves formed around a periphery thereof.

12. The modular shell system of claim 1, wherein said plurality of shell heads of different types include at least one shell head formed of plastics material.

13. The modular shell system of claim 1, wherein said different types of fillings include ballast filling, flare compound filling, tear gas filling, detonation charge filling, marking dye filling, marking dye filling with light trace, and smoke compound filling.

14. A modular shell system comprising:

a shell body formed as a container;

a plurality of fillings of different types, said different types including at least one explosive type and at least one non-explosive type, one of said fillings to be contained within said shell body; and a plurality of shell heads of different types, each of said different types of shell heads being appropriate for use with at least one of said different types of fillings, an appropriate one of said shell heads to be connected to said shell body based on said one of said fillings to be contained within said shell body, whereby said one of said fillings is enclosed by said shell body and said appropriate one of said shell heads.

15. The modular shell system of claim 14, wherein said shell body has a thread formed at an edge of said shell body, each of said shell heads being operable to be connected to said shell body by being screwed onto said thread of said shell body.

16. The modular shell system of claim 15, wherein said plurality of shell heads includes at least one type of shell head having ray-shaped predetermined breakage points.

17. The modular shell system of claim 15, wherein said plurality of shell heads includes at least one type of shell head having a plurality of grooves formed around a periphery thereof.

18. The modular shell system of claim 14, wherein said plurality of shell heads includes at least one of shell head having ray-shaped predetermined breakage points.

19. The modular shell system of claim 18, wherein said plurality of shell heads further includes at least one type of shell head having a plurality of grooves formed around a periphery thereof.

20. The modular shell system of claim 14, wherein said plurality of shell heads includes at least one type of shell head having a plurality of grooves formed around a periphery thereof.

* * * * *